US009484628B2

(12) United States Patent
Petros

(10) Patent No.: US 9,484,628 B2
(45) Date of Patent: Nov. 1, 2016

(54) MULTIBAND FREQUENCY ANTENNA

(71) Applicant: Argy Petros, Coconut Creek, FL (US)

(72) Inventor: Argy Petros, Coconut Creek, FL (US)

(73) Assignee: Think Wireless, Inc, Coconut Creek, FL (US)

( * ) Notice: Subject to any disclaimer, the term of this patent is extended or adjusted under 35 U.S.C. 154(b) by 237 days.

(21) Appl. No.: 14/274,665

(22) Filed: May 9, 2014

(65) Prior Publication Data

US 2015/0097754 A1 Apr. 9, 2015

Related U.S. Application Data

(60) Provisional application No. 61/821,576, filed on May 9, 2013.

(51) Int. Cl.

| | |
|---|---|
| ***H01Q 5/00*** | (2015.01) |
| ***H01Q 1/36*** | (2006.01) |
| ***H01Q 5/378*** | (2015.01) |
| *H01Q 11/08* | (2006.01) |

(52) U.S. Cl.
CPC ..... *H01Q 1/362* (2013.01); *H01Q 5/378* (2015.01); *H01Q 11/08* (2013.01)

(58) Field of Classification Search
CPC ..... H01Q 1/362; H01Q 5/378; H01Q 51/36; H01Q 51/362; H01Q 11/08
See application file for complete search history.

(56) References Cited

U.S. PATENT DOCUMENTS

| | | | | |
|---|---|---|---|---|
| 4,772,895 | A * | 9/1988 | Garay | H01Q 1/362 343/752 |
| 5,559,524 | A * | 9/1996 | Takei | H01Q 1/362 343/872 |
| 5,650,792 | A * | 7/1997 | Moore | H01Q 1/362 343/725 |
| 5,945,964 | A * | 8/1999 | DeGroot | H01Q 1/244 343/702 |
| 5,986,619 | A * | 11/1999 | Grybos | H01Q 1/288 343/853 |
| 5,990,848 | A * | 11/1999 | Annamaa | H01Q 11/08 343/725 |
| 6,133,891 | A * | 10/2000 | Josypenko | H01Q 11/08 343/860 |
| 6,388,625 | B1 * | 5/2002 | Fukushima | H01Q 1/241 343/702 |
| 7,158,819 | B1 * | 1/2007 | Pulimi | H01Q 1/362 343/702 |
| 7,639,202 | B2 * | 12/2009 | Takaoka | H01Q 1/1207 343/895 |
| 8,552,922 | B2 * | 10/2013 | Igwe | H01Q 11/08 343/705 |

* cited by examiner

*Primary Examiner* — Michael Zarroli

(57) ABSTRACT

Disclosed is an antenna capable of operating at more than one frequency band. The antenna comprises a first main helix antenna element and a second parasitic helix antenna element electromagnetically coupled to integrate a single radiofrequency connection structure operating in dual frequency bands. Furthermore, the antenna is configured to structurally combine a plurality of helix antenna elements to operate at multiple frequency bands having only one radiofrequency connector.

18 Claims, 3 Drawing Sheets

MULTIBAND FREQUENCY ANTENNA

CROSS REFERENCE TO RELATED APPLICATION

This application is based upon and claims priority from co-pending U.S. Provisional Patent Application Ser. No. 61/821,576 entitled "MULTIBAND FREQUENCY ANTENNA" filed with the U.S. Patent and Trademark Office on May 9, 2013, by the inventor herein, the specification of which is incorporated herein by reference.

FIELD OF THE INVENTION

The present invention relates to antenna systems. More particularly, the present invention relates to an antenna capable of operating at more than one frequency band for use in communication and navigation systems.

BACKGROUND OF THE INVENTION

Helical antennas have been used over the last years in multiple radiofrequency (RF) applications. A number of references describe and analyze helical antennas both in single and array configurations. A detailed description of helical antennas is presented in the book titled *Antennas*, Second Edition, by J. D. Kraus, McGraw-Hill, New York, N.Y., 1988, in Chapter 7. A number of helical antenna configurations, including a dual-helix antenna comprising a parasitic helix of approximately the same diameter wound over another helix antenna to increase the overall antenna system gain, are described in Kraus's book. However, Kraus does not address the use of parasitic helix antennas as a means to provide a multiband frequency antenna using a single feeding point.

The performance of a helix antenna is determined by its geometry. Where the diameter of the helix is small compared to one wavelength, corresponding to the center frequency of operation of the antenna, the helix antenna is capable to radiate electromagnetic energy in a so called "normal" mode. This mode generates an antenna pattern generally perpendicular to the helix axis, which is somehow similar to the fundamental antenna radiation pattern of a monopole. However, a helix antenna typically is shorter in length, higher in bandwidth, and larger in gain as compared to a monopole antenna. Despite these advantages, in the Very High Frequency (VHF) band, the size of the antennas may still be relatively large and impractical for certain applications in the satellite, handheld device, and automotive industries. As a result, helix antennas have been configured in a concentric or coaxial arrangement with one antenna within another to reduce the volume required for their practical implementation by offering a more compact antenna structure.

In particular, the design of multiband helical antennas concentrically arranged has been addressed in the prior art, as described in U.S. Pat. No. 5,986,619 to Grybos et al. However, these efforts have faced certain challenges and limitations. Specifically, attempts made to provide a multiband helical antenna using concentric or coaxial structures have been limited to multiple feeds or complex and costly configurations. A major challenge is that multiband antennas requiring multiple feeds are bulkier and heavier, because of the need to use multiple RF connectors, RF cables, and RF ports to connect the multiband antenna system to the corresponding devices, according to the intended applications. In addition, these antenna systems may be more complex and costly to implement.

In recent years, the advent of emerging communication and navigation applications have resulted in an increased demand of multiband antennas that are more compact and simple to implement. Accordingly, an opportunity exist to integrate multiple helix antennas and at the same time provide a single connection point to the antenna, which also results in a more compact, lighter, simpler and more cost-effective antenna system.

A way to address the disadvantages of the efforts attempted by the prior art is to design a multiband frequency antenna system, in the VHF frequency band, having a single feeding point. This would make possible to reduce the volume occupied by the antenna system and provide a single signal to a single port of a receiver or a transmitter connected to the antenna through a single coaxial cable. Currently, there is no well-established, easy to manufacture multiband antenna design that provides enough bandwidth and operates using a single RF connection or feeding point, especially for applications in the VHF frequency band.

Thus, there remains a need in the art for a multiband antenna capable of operating using a single RF connection or feeding point for multiple applications at various frequencies that avoid the problems of prior multiband helical antennas.

SUMMARY OF THE INVENTION

An antenna capable of operating at more than one frequency band, having a single feeding point is disclosed herein. One or more aspects of exemplary embodiments provide advantages while avoiding disadvantages of the prior art. The antenna comprises a first main helix antenna element and a second parasitic helix antenna elements electromagnetically coupled to integrate a single radiofrequency connection structure operating in dual frequency bands. The antenna is designed to be compact and reduce size, weight, and cost, while increasing versatility as compared to equivalent single-band frequency antennas designed using traditional design techniques.

The dimensions and relative location of the helix antenna elements are selected so that a smaller diameter helix antenna element is positioned coaxially inside a larger diameter helix antenna element, such that both antenna elements couple electromagnetically to resonate at two distinct frequency bands. The smaller diameter antenna resonates at a higher frequency while the larger diameter antenna resonates at a lower frequency. The combined antennas are capable of operating at multiple frequency bands by feeding only one of the antenna elements. Thus, only a single antenna structure, a single RF connector, and a single transmission line are required for a multiband frequency operation.

The specific frequencies of operation and their associated frequency bandwidths of the multiband frequency antenna are determined by the diameter, pitch size or spacing between two adjacent helical elements, and number of turns of the helix antennas. Furthermore, the proximity between the two antenna elements and the amount of overlapping between them should also be considered. In addition, the dielectric permittivity of the medium in which each helix antenna element is wound and the diameter of the wire used to build the helix antenna elements will influence the performance of the overall antenna system.

By integrating two helical antennas in a coaxial configuration, such that one parasitic helix antenna electromagnetically couples to a main helix antenna connected to a receiver device or a transmitter device, it may be possible to operate these devices at more than one frequency by means of a single RF connection or a single feed. Thus, based on this concept, on top of reducing size, weight, and cost, multiple applications having different frequency bands of operation may be implemented using a single-feed, multiband frequency antenna structure to prevent the need of using multiple antennas, multiple transmission lines, multiple transmitter or receiver ports, and the substantial larger area required to install them.

BRIEF DESCRIPTION OF THE DRAWINGS

The numerous advantages of the present invention may be better understood by those skilled in the art by reference to the accompanying drawings in which.

DETAILED DESCRIPTION

The following description is of one or more aspects of the invention, set out to enable one to practice an implementation of the invention, and is not intended to any specific embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
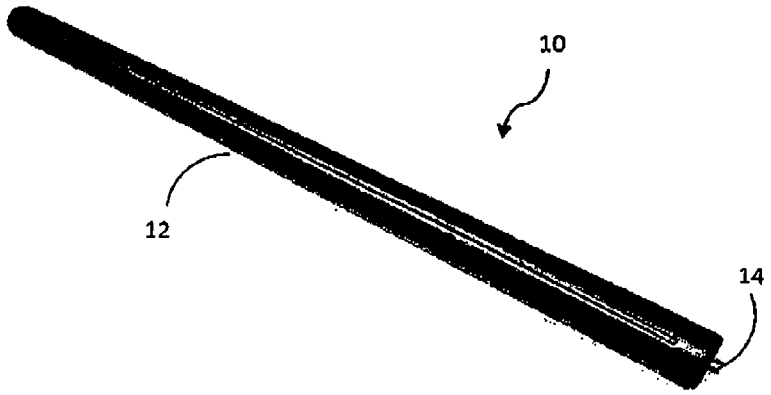
FIG. 1 shows a top view of an 8-inch mast antenna existing in the prior art.

FIG. 1 shows a commercial 8-in mast antenna 10 used for Frequency Modulation (FM) radio applications. Antenna 10 comprises an antenna radiation element (not shown) contained within antenna enclosure 12. Enclosure 12 provides sturdiness to antenna 10 and protects said antenna radiation element from exposure to environmental effects such as those caused by wind, water, snow, ice, sand, salt and others, which may compromise the operational performance of said antenna radiation element. Antenna 10 also includes an RF connector 14 to electromagnetically interconnect said antenna radiation element of antenna 10 directly or indirectly, by means of a transmission line such as a coaxial cable, to a receiver (not shown) or a transmitter (not shown) operating in the FM frequency band.

A figure of merit generally used to evaluate the performance of antenna 10 is return loss, RL. Those skilled in the art will recognize that an antenna having a good performance typically has a return loss of 10 dB or larger. Alternatively, the magnitude of the S11 scattering parameter, |S11|, is also used to evaluate antenna performance, considering the following existing relationship between RL and |S11|:

$$|S11| \text{ (in dB)} = -\text{RL (in dB)}$$

Figure 2:
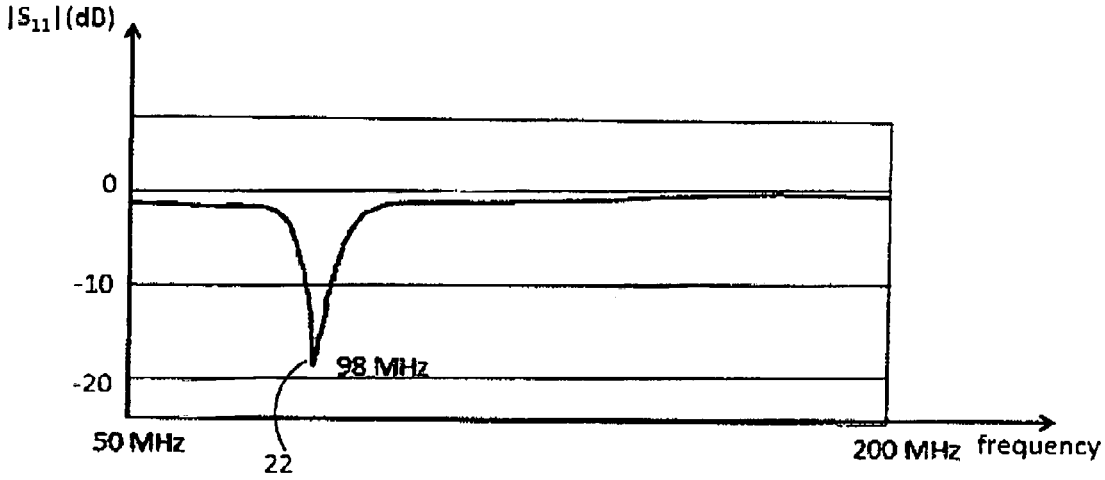
FIG. 2 shows the magnitude of the S11 parameter, as a function of frequency, corresponding to the prior art 8-in mast antenna of FIG. 1.

Therefore, an antenna having a very good performance, in terms of return loss, typically has a value of |S11| equal or lower than −10 dB. FIG. 2 shows the magnitude of the S11 scattering parameter, |S11|, as a function of frequency, corresponding to antenna 10. Typically, the tuning frequency of antenna 10 corresponds approximately to the lowest value of |S11| and is targeted at the center of the operational frequency band of interest. FIG. 2 indicates that the lowest value 22 of |S11| occurs approximately at 98 MHz, which correspond to the center of the FM frequency band. The lowest value 22 of |S11| of antenna 10 is about −18 dB, as shown in FIG. 2. This means that antenna 10 is effectively tuned and effectively operates, in terms of return loss, at around 98 MHz.

Figure 3:
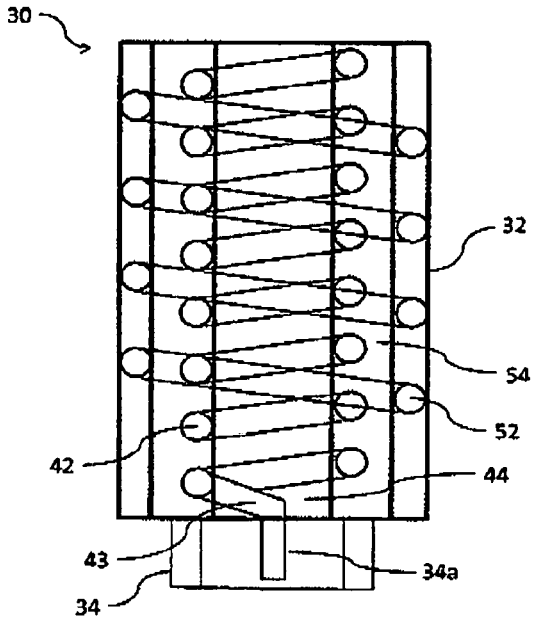
FIG. 3 shows a longitudinal section view of a dual-band frequency antenna corresponding to an exemplary embodiment of the antenna of the present invention.

FIG. 3 shows a longitudinal section view of an exemplary configuration of a dual-band frequency antenna 30, in accordance with aspects of an embodiment of the invention. Antenna 30 comprises an enclosure 32, which encloses a first antenna element, consisting of a main helix antenna 42, and a first dielectric substrate, consisting of supporting element 44. In addition, enclosure 32 encloses a second antenna element, consisting of a parasitic helix antenna 52, and a second dielectric substrate 54. Furthermore, antenna 30 comprises an RF connection point, such as a coaxial connector 34, to electrically connect, directly or indirectly, one end 43 of first antenna element 42 to a receiver (not shown) or a transmitter (not shown) through a conductor element 34*a* of connector 34. Antenna enclosure 32 is made of a nonconductive material, such as plastic, usually rigid and waterproof, to provide sturdiness and to protect components, enclosed by antenna enclosure 32, from exposure to environmental effects such as those caused by wind, water, snow, ice, sand, salt and others, which may compromise the operational performance of the antenna elements enclosed within enclosure 32.

Figure 4:
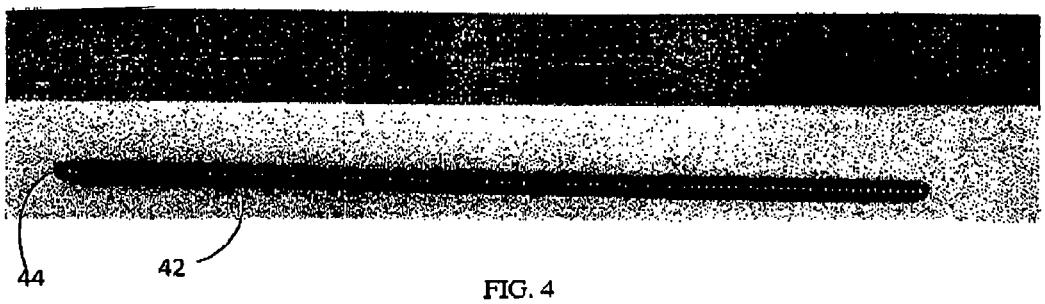
FIG. 4 shows a perspective view of a main helix prototype corresponding to an exemplary embodiment of the antenna of the present invention.

FIG. 4 shows a prototype of an exemplary configuration of first antenna element enclosed within enclosure 32, in accordance with aspects of an embodiment of the invention, comprising a main helix antenna element 42 and a first dielectric substrate consisting of supporting element 44. Main helix antenna element 42 is implemented by means of a wire made of a conductive material, such as copper or aluminum, whereas supporting element 44 is made of a dielectric material, such as plastic. A dielectric material is non-conductive of an electric current at the frequencies of operation of main helix antenna 42. Main helix antenna element 42 is wound around supporting element 44 while maintaining an approximate constant separation between any two consecutive windings of main helix antenna element 42, such that there is no overlapping between any of the windings of main helix antenna 42. In other words, the winding of main helix antenna element 42 around supporting element 44 describes a helix along supporting element 44.

Figure 5:
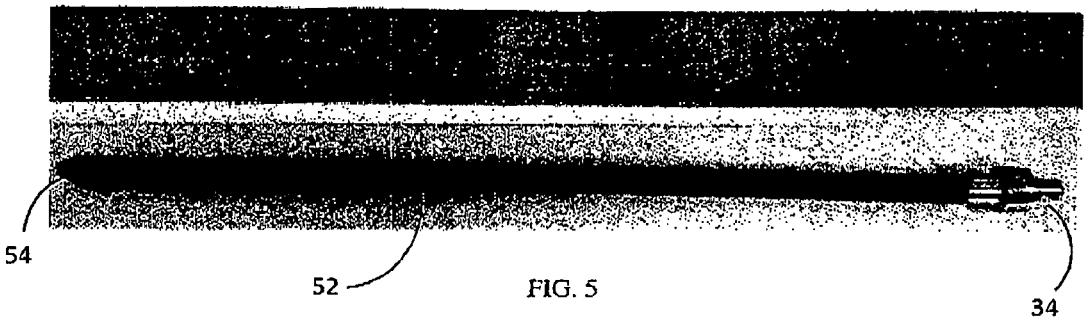
FIG. 5 shows a perspective view of a parasitic helix antenna prototype, wound around a dielectric substrate which encloses the main helix antenna of FIG. 4, corresponding to an exemplary embodiment of the antenna of the present invention.

FIG. 5 shows a prototype of an exemplary configuration of second antenna element enclosed within enclosure 32, in accordance with aspects of an embodiment of the invention, comprising a parasitic helix antenna element 52, a second dielectric substrate 54, and RF connector 34. Parasitic helix antenna element 52 is wound around dielectric substrate 54. Parasitic helix antenna element 52 is implemented by means of a wire made of a conductive material, such as copper or aluminum. Dielectric substrate 54 is disposed over main helix antenna element 42, which is wound around supporting element 44 to prevent physical and direct electrical contact between parasitic helix antenna 52 and main helix antenna 42. In this configuration, a heat shrink plastic tubing, as well-known in the prior art, is applied to main helix antenna 42 to electrically isolate main helix antenna element 42 and parasitic helix antenna element 52. RF connector 34 allows electrically connecting main antenna element 42 (not shown) to a receiver (not shown) or a transmitter (not shown).

Parasitic helix antenna element 52 is wound around a portion of dielectric substrate 54 opposite an end of main helix antenna element 42 connected to RF connector 34, while maintaining an approximate constant separation between any two consecutive windings of parasitic helix antenna element 52, such that there is no overlapping between any of the windings of parasitic helix antenna element 52. In other words, the winding of parasitic helix antenna element 52 around dielectric substrate 54 describes a helix along dielectric substrate 54. Therefore, parasitic helix antenna 52 is not electrically connected to main helix antenna element 42; instead parasitic helix antenna element 52 is electromagnetically coupled to main helix antenna element 42.

Thus, referring to FIG. 4 and FIG. 5, an exemplary configuration of a dual-band frequency antenna, in accordance with aspects of an embodiment of the invention for a VHF band application, comprises a dual-helix antenna with a first main helix antenna 42, electrically connected to RF connector 34, and a second parasitic helix antenna 52, having a larger diameter than first main helix antenna 42, coaxially positioned around the main helix antenna. The diameter of each of the helical antennas is unique. In particular, two frequency bands are of interest within the VHF frequency band. First, the FM frequency band, which in the United States ranges from 88 to 108 MHz, and second, the Weather radio frequency band, which ranges from 162.4 to 162.550 MHz. Therefore, in this configuration, the multiband frequency antenna tuning is targeted at the center of the two frequency bands of interest, i.e., 98 MHz and 162.475 MHz, respectively. In general, the performance of a helix antenna is dictated by key design parameters, which generally include the diameter of the circumference described by the helix antenna in a plane normal to the antenna main axis spiral direction, the diameter of the wire used to build the antenna, the pitch size or spacing between two adjacent helical elements, and the antenna length or alternatively the number of turns.

Because of the electromagnetic coupling effects of parasitic helix antenna 52, main helix antenna element 42 is detuned to operate at a lower frequency as compared to a standalone configuration. Thus, main helix antenna element 42 is individually tuned to a frequency higher than 98 MHz to compensate for the effects of parasitic helix antenna element 52, such that main helix antenna element 42 is retuned at about 98 MHz when operating in combination with parasitic helix antenna element 52, to operate in the FM frequency band. Additionally, parasitic helix antenna element 52 is designed such that it creates a second tuning frequency of operation at about 162.475 MHz, when operating in combination with main helix antenna element 42, to cover the Weather frequency band. Thus, in this configuration, it is possible to operate a dual-frequency antenna system (FM and Weather frequency bands) using a single connection point through RF connector 34.

The dual frequency band operation featured by this configuration is achieved by properly selecting the key design parameters of the dual-helix antenna system, which for main helix antenna element 42 correspond to approximately an inner diameter of 5 mm, a 1.5-mm pitch size, a total number of 118 turns, and a length of 177 mm. Main helix antenna element 42 is wound in a counterclockwise spiral direction around a cylindrical plastic rod of approximately 5-mm diameter and 180-mm length. A heat shrink tubing is applied to main helix antenna element 42 to prevent physical and direct electrical contact between parasitic helix antenna element 52 and main helix antenna element 42, such that the desired effects of parasitic helix antenna element 52 are achieved by electromagnetic coupling to main helix antenna element 42. Parasitic helix antenna element 52 is wound in a counterclockwise spiral direction around the heat shrink tubing. Likewise, in this configuration, the design parameters of parasitic helix antenna element 52 are approximately an inner diameter of 6 mm, a 10.5-mm pitch size, a total number of 9 turns, and a length of 95 mm. The thickness of the wire used to build both, main helix antenna element 42 and parasitic helix antenna element 52, is approximately 0.5 mm.

Figure 6:
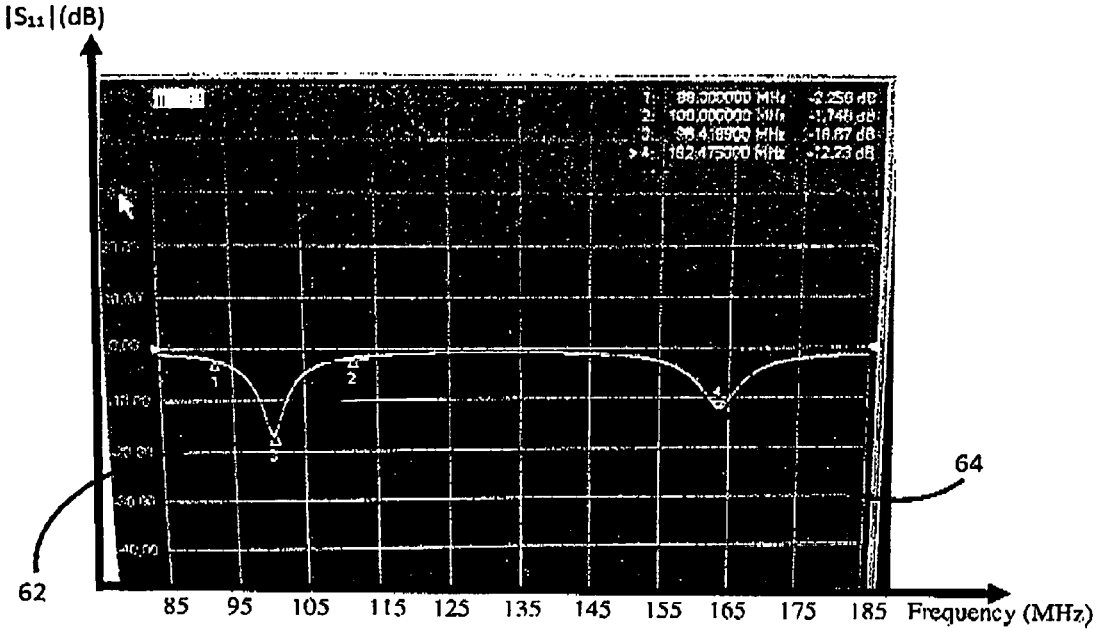
FIG. 6 shows the magnitude of the S11 parameter, as a function of frequency, corresponding to the prototype of an exemplary embodiment of the antenna of the present invention.

FIG. 6 shows measurement results of the magnitude of the S11 scattering parameter, |S11|, as a function of frequency, corresponding to a prototype of an exemplary configuration of a dual-band frequency antenna, in accordance with aspects of an embodiment of the invention. There are two frequency regions at which the value of |S11| reaches distinctive low values 62, 64. Low value 62 of |S11| occurs at around 98 MHz, which correspond to the center of the FM frequency band. Low value 62 of |S11| is approximately −16.7 dB, as shown in FIG. 6. This performance is comparable to that of commercial antenna 10 as illustrated in FIG. 2. Additionally, FIG. 6 shows another distinctive low value 64 of |S11| at a second frequency close to 162.475 MHz, which correspond to the center of the Weather frequency band. Low value 64 of |S11| is approximately −12.2 dB, as shown in FIG. 6. This means that the prototype corresponding to this configuration is suitable to operate at both the FM frequency band and the Weather frequency band.

In another exemplary configuration of a multiband frequency antenna, in accordance with aspects of an embodiment of the invention, first main helix antenna element 42 and second parasitic helix antenna element 52 are concentrically positioned with respect to one another. In yet another configuration, a first main helix antenna element 42, electrically connected to RF connector 34, is wound around a second parasitic helix antenna element 52, having each of the antenna elements coaxially positioned with respect to one another. Alternatively, first main helix antenna element 42 and second parasitic helix antenna element 52 are not positioned coaxially, such as in a side-to-side configuration, or not positioned concentrically, such as an end-to-end configuration. In addition, main helix antenna element 42 and parasitic helix antenna element 52 may be wound in opposite senses or spiral direction, i.e., one counterclockwise and the other clockwise. Furthermore, main helix antenna element 42 and parasitic helix antenna element 52 may be designed to each or both have a variable pitch size or a variable helix diameter.

Those skilled in the art will recognize that in accordance to one or more aspects of the invention, more than one parasitic antenna elements may be used to tune and enable a multi-element antenna system to operate at multiple frequencies. Likewise, those skilled in the art will recognize that main helix antenna element 42 may be connected to RF connector 34 through a number of electrical and electronic devices and components including amplifiers, impedance matching networks, switches, and others with the purpose of improving an overall system performance for a particular application.

In certain applications, the use of a printed circuit comprising a rigid or a flexible dielectric substrate, including a printed circuit board or a flexible printed circuit, offers an option to reduce the overall size occupied by the antenna or to conform to a platform in which the antenna will be installed. Therefore, other forms of the configurations described herein may include supporting elements or supporting structures comprising rigid or flexible dielectric substrates. Additionally, planar strips of conductive elements, instead of wires, may be used to implement the helical antenna elements disposed on either such supporting elements or supporting structures.

In any of the configurations described herein, the multiband frequency antenna may operate in an elliptical polarization, including a generally linear polarization and a generally circular polarization and as part of a single, diversity, multiple input multiple output (MIMO), reconfigurable, or beam forming network system.

The various embodiments have been described herein in an illustrative manner, and it is to be understood that the terminology used is intended to be in the nature of words of description rather than of limitation. Any embodiment herein disclosed may include one or more aspects of the other embodiments. The exemplary embodiments were described to explain some of the principles of the present invention so that others skilled in the art may practice the invention. Obviously, many modifications and variations of the invention are possible in light of the above teachings. The present invention may be practiced otherwise than as specifically described within the scope of the appended claims and their legal equivalents.

I claim:

1. A multiband frequency antenna, capable of operating at least at two different frequency bands, comprising:

a first helix antenna element having a first end and a second end;

a second helix antenna element having a first end and a second end;

a first dielectric;

a second dielectric; and a radiofrequency connection point;

wherein said first end of said first helix antenna element provides a means for coupling radiofrequency signals from and to said multiband frequency antenna; wherein said first helix antenna element is at least partly disposed on said first dielectric; wherein said second helix antenna element is at least partly disposed on said second dielectric; wherein said first helix antenna element is at least partly positioned within said second helix antenna element; wherein said second helix antenna element is electromagnetically coupled to said first helix antenna element; wherein said first end and said second end of said second helix antenna element are electrically ungrounded and physically unconnected to an electrical conductor; wherein said multiband frequency antenna is coupled to said radiofrequency connection point at said first end of said first helix antenna element, and wherein said first dielectric is air.

2. The antenna of claim 1, wherein said first helix antenna element and said second helix antenna element are substantially concentric with respect to one another.

3. The antenna of claim 1, wherein a main axis of said first helix antenna element and a main axis of said second helix antenna element are substantially parallel with respect to one another.

4. The antenna of claim 3, wherein said main axis of said first helix antenna element and said main axis of said second helix antenna element are substantially superimposed.

5. The antenna of claim 1, wherein said radiofrequency connection point comprises a radiofrequency connector electrically coupled to said first end of said first helix antenna element.

6. The antenna of claim 5, wherein said radiofrequency connector is a radiofrequency coaxial connector.

7. The antenna of claim 1, wherein said first helix antenna element, said second helix antenna element, said first dielectric, and said second dielectric are configured such that an input impedance at said first end of said first helix antenna element substantially matches an input impedance of a transmission line coupled to said first end of said first helix antenna element.

8. The antenna of claim 1, wherein said first helix antenna element and said second helix antenna element are made of a conductive wire.

9. The antenna of claim 1, wherein said first helix antenna element and said second helix antenna element are made of a conductive strip.

10. The antenna of claim 1, wherein said second dielectric comprises a flexible substrate.

11. The antenna of claim 1, further comprising an enclosure enclosing said first helix antenna element, said second helix antenna element, said first dielectric, and said second dielectric.

12. The antenna of claim 11, further comprising a radiofrequency connector electrically coupled to said first end of said first helix antenna element.

13. The antenna of claim 1, wherein said first helix antenna element and said second helix antenna element are wound in the same spiral direction.

14. The antenna of claim 1, wherein said first helix antenna element and said second helix antenna clement are wound in opposite spiral directions.

15. The antenna of claim 1, wherein said wherein said first helix antenna element and said second helix antenna element are configured to transmit and receive circularly polarized signals.

16. The antenna of claim 1, wherein said wherein said first helix antenna element and said second helix antenna element are configured to transmit and receive linearly polarized signals.

17. A multiband frequency antenna, capable of operating at least at two different frequency bands, comprising:

a first helix antenna element having a first end and a second end;

a second helix antenna element having a first end and a second end;

a first dielectric;

a second dielectric; and a radiofrequency connection point;

wherein said first end of said first helix antenna element provides a means for coupling radiofrequency signals from and to said multiband frequency antenna; wherein said first helix antenna element is at least partly disposed on said first dielectric; wherein said second helix antenna element is at least partly disposed on said second dielectric; wherein said first helix antenna element is at least partly positioned within said second helix antenna element; wherein said second helix antenna element is electromagnetically coupled to said first helix antenna element; wherein said first end and said second end of said second helix antenna element are electrically ungrounded and physically unconnected to an electrical conductor; wherein said multiband frequency antenna is coupled to said radiofrequency connection point at said first end of said first helix antenna element, and wherein a diameter of at least one of said helical antenna elements is non-constant.

18. A multiband frequency antenna, capable of operating at least at two different frequency bands, comprising:

a first helix antenna element having a first end and a second end;

a second helix antenna element having a first end and a second end;

a first dielectric;

a second dielectric; and a radiofrequency connection point;

wherein said first end of said first helix antenna element provides a means for coupling radiofrequency signals from and to said multiband frequency antenna; wherein said first helix antenna element is at least partly disposed on said first dielectric; wherein said second helix antenna element is at least partly disposed on said second dielectric; wherein said first helix antenna element is at least partly positioned within said second helix antenna element; wherein said second helix antenna element is electromagnetically coupled to said first helix antenna element; wherein said first end and said second end of said second helix antenna element are electrically ungrounded and physically unconnected to an electrical conductor; wherein said multiband frequency antenna is coupled to said radiofrequency connection point at said first end of said first helix antenna element, and wherein a pitch size of at least one of said helical antenna elements is non-constant.

* * * * *